US006276773B1

(12) United States Patent
Takizawa

(10) Patent No.: US 6,276,773 B1
(45) Date of Patent: Aug. 21, 2001

(54) DRIVE METHOD AND DRIVE OF INK-JET RECORDING HEAD

(75) Inventor: Fuminori Takizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/613,516

(22) Filed: Jul. 10, 2000

(30) Foreign Application Priority Data

Jul. 15, 1999 (JP) ..... 11-201261

(51) Int. Cl.[7] ..... B41J 29/38
(52) U.S. Cl. ..... 347/10; 347/11; 347/9
(58) Field of Search ..... 347/9, 10, 11, 347/68

(56) References Cited

FOREIGN PATENT DOCUMENTS

| | | | | |
|---|---|---|---|---|
| 0 827 838 | * | 3/1998 | (EP) | B41J/2/21 |
| 53-12138 | | 4/1978 | (JP) | G06K/15/00 |
| 4118245 | | 4/1992 | (JP) | B41J/2/05 |
| 4361055 | | 12/1992 | (JP) | B41J/2/205 |
| 911457 | | 1/1997 | (JP) | B41J/2/045 |
| 9164706 | | 6/1997 | (JP) | B41J/2/205 |
| 9174884 | | 7/1997 | (JP) | B41J/2/205 |
| 10-81012 | | 3/1998 | (JP) | B41J/2/045 |
| 10-109433 | * | 4/1998 | (JP) | B41J/2/205 |
| 10-193587 | | 7/1998 | (JP) | B41J/2/01 |
| 11-58719 | * | 3/1999 | (JP) | B41J/2/01 |

* cited by examiner

*Primary Examiner*—John Barlow
*Assistant Examiner*—A. Dudding
(74) *Attorney, Agent, or Firm*—Ostrolenk, Faber, Gerb & Soffen, LLP

(57) ABSTRACT

A drive method and a drive of an ink-jet recording head which is capable of improving recording speed widely, and which is capable of materializing high quality recording without extending recording time even though the number of gradations increase, are provided. One-printing period T is divided into a plurality of segment T1, T2. The method and device cause plural kinds of drive-voltage-waveform SD1 to SD6 to be generated in accordance with size of an ink-drop in every respective segment T1, T2. The method and device select arbitrary drive-voltage-waveforms from among the plural kinds of drive-voltage-waveforms SD1 to SD6 supplied in every respective segment T1, T2 to supply to a vibration generator in every respective segment T1, T2. Thus it becomes possible to obtain a plurality of gradations during one-printing period T. It is capable of obtaining high quality printing image while improving recording speed widely. Further, printing time is not extended even though the number of gradations increase.

10 Claims, 18 Drawing Sheets

FIG. 7
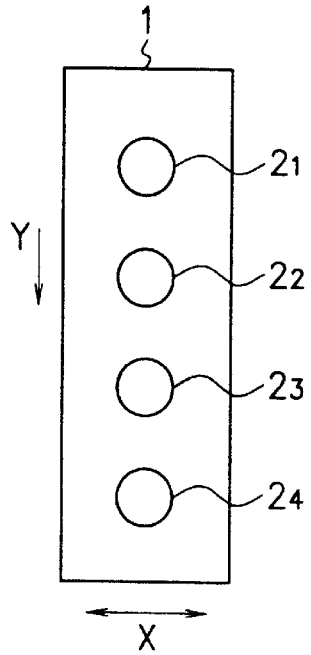
FIG. 8A
FIG. 8B
FIG. 8C
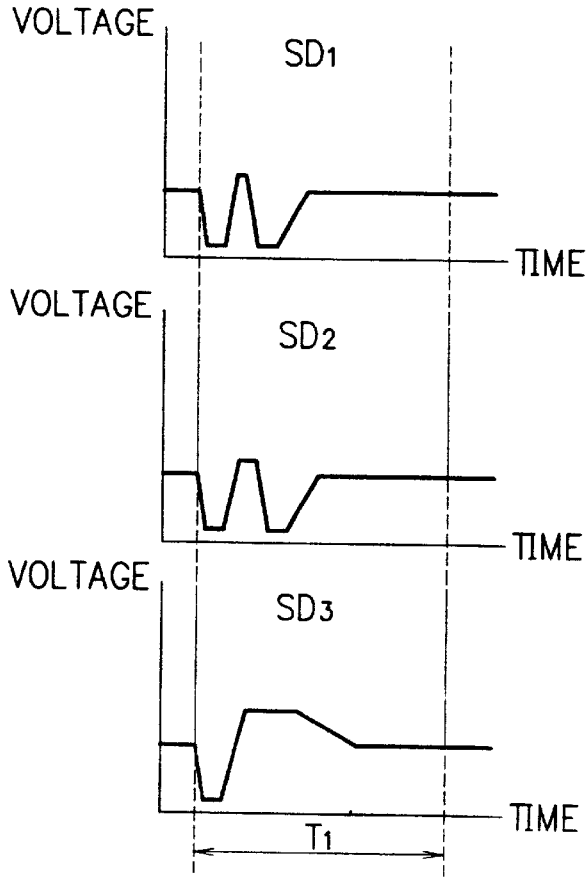

FIG. 13

| GRADATION VALUE DETERMINED BY PRINT-OUT DATA | FIRST WAVEFORM SELECTION DATA | SECOND WAVEFORM SELECTION DATA |
|---|---|---|
| 0 | 000 | 000 |
| 1 | 100 | 000 |
| 2 | 000 | 100 |
| 3 | 010 | 000 |
| 4 | 000 | 010 |
| 5 | 001 | 000 |
| 6 | 000 | 001 |

| GRADATION VALUE DETERMINED BY PRINT-OUT DATA | FIRST WAVEFORM SELECTION DATA | SECOND WAVEFORM SELECTION DATA |
|---|---|---|
| 0 | 000 | 100 |
| 1 | 100 | 000 |
| 2 | 010 | 000 |
| 3 | 000 | 010 |
| 4 | 001 | 000 |
| 5 | 000 | 001 |

FIG. 22

| GRADATION VALUE DETERMINED BY PRINT-OUT DATA | FIRST WAVEFORM SELECTION DATA | SECOND WAVEFORM SELECTION DATA |
|---|---|---|
| 0 | 000 | 100 |
| 1 | 100 | 000 |
| 3 | 010 | 010 |
| 6 | 001 | 001 |

DRIVE METHOD AND DRIVE OF INK-JET RECORDING HEAD

BACKGROUND OF THE INVENTION

The present invention relates to an inkjet recording head for recording a character and a pattern and so forth to recording medium in such a way that the drive method and the drive cause volume of ink chamber in which ink is filled up to be changed according to function of actuator such as piezoelectric vibration element. The change of volume causes infinitesimal ink-drop to be discharged from a nozzle penetrating continuously to the ink chamber. More to particularly, this invention relates to a drive method and a drive for driving this inkjet recording head.

DESCRIPTION OF THE PRIOR ART

The Japanese Patent Publication No. SHO 53-12138, The Japanese Patent Application Laid-Open No. HEI 10-193587, and so forth disclose drop-on-demand type ink-jet recording device. The drop-on-demand type ink-jet recording device causes an ink chamber in which ink is filled to be changed in terms of volume of the chamber (expansion/contraction) while employing the actuator such as the piezoelectric vibration element and so forth. It causes the ink-drop to be discharged from a point of a nozzle which is formed to be penetrated continuously to said ink chamber in accordance with change of pressure of internal part of the ink chamber.

FIG. 1 is a block diagram showing a drive of ink-jet recording head according to the conventional example of the present invention. FIG. 2 is a sectional outline view for explaining constitution of an ink-jet recording head driven by the drive of FIG. 1. FIG. 3 is an outline plan view showing relationship between the recording medium and the ink-jet recording head in the ink-jet printer. FIG. 4 is a graph showing one example of drive-waveform (waveform according to voltage, hereinafter referred to as drive-voltage-waveform) which is supplied to the actuator in every one-printing period. FIG. 5 is a view showing dot formed by the drive-voltage-waveform of FIG. 4.

The ink-jet recording head 1 includes a nozzle plate 3 on which a plurality of nozzles (orifice) are formed, an ink chamber 4 provided corresponding to respective nozzles 2, in which the ink 11 discharged from the nozzles 2 is filled, an ink supplying path 5*a* for supplying ink 11 to the ink chamber 4 from an ink tank which is not illustrated, and an actuator 7 provided corresponding to respective ink chambers 4.

Further, the ink chamber 4 expands and is contracted due to the fact that it causes the actuator to be driven, thus the ink filled up in the internal part is discharged from the nozzle 2 caused by the change of volume.

The drive for driving this ink-jet recording head 1, as sown in FIG. 1, includes a waveform generator 23 for generating the drive-voltage-waveform in order to supply to the actuator 7, a drive-waveform storage means 22 in which information for generating the drive-voltage-waveform at the waveform generator is stored therein beforehand, a switching part 24 for switching the drive-voltage-waveform for supplying to the actuators 7, 7 . . . provided corresponding to respective nozzles 2, and controller 21 for transferring signal among the drive-waveform storage means 22, the waveform generator 23, the actuators 7, 7, . . . , the switching part 24 and so forth, and for controlling thereof For instance, the drive-voltage-waveform as shown in FIG. 4 is supplied to the actuators 7, 7, . . . . The ink-drop 11 forming a dot D as shown in FIG. 5 is discharged from the nozzle 2 according to the drive-voltage-waveform.

The waveform generator 23 is provided with a single waveform generation circuit 25. The waveform generation circuit 25 is connected to respective actuators 7, 7, . . . by the signal line. A switch 27 is provided for a branching signal line for branching signal from the signal line to respective actuators 7, 7, . . . . A switching of this switch 27 is implemented by a nozzle selection circuit 26 of the switching part 24. The nozzle selection circuit 26 executes switching of ON, OFF of the switch 27 according to DSN command signal provided from the controller 21. The drive-waveform storage means 22 stores therein information in connection with generation of the drive-voltage-waveform to be applied to the actuator 7.

The ink-jet recording head 1 above described constitution causes the controller 21 to control a driving of a drive body for the sake of movement of the ink-jet recording head 1 in accordance with a command signal from the external part. The ink-jet recording head 1 causes the controller 21 to control a driving of a drive body of feed roller for feeding recording medium. Subsequently, it causes the nozzle selection data DSN to be transmitted to the switching part 24 in every one-printing period. Thus, it causes a discharging start command to be transmitted to the waveform generator 23 with appropriate timing.

As shown in FIG. 3, the ink-jet recording head 1 moves in the direction of horizontal scanning (X-axis direction) along a guide 12 provided for the ink-jet printer body which is not illustrated, and causing the recording medium 13 to be fed in the direction of vertical scanning (Y-axis direction) perpendicular to the direction of horizontal scanning according to the feed roller 14, thus print is performed while forming a great deal of dots on the recording medium 13. On this occasion, the nozzle 2 passes arbitrary pixel position on the recording medium 13 by only one time.

Now then, various kinds of ink-jet recording heads, drives thereof, and drive methods are proposed except for those shown in FIGS. 1 to 3, as the inkjet recording head, drive thereof, and drive method whose discharging enforcement (discharging method, discharging timing, diameter of ink-drop, and so forth) of the ink-drop is improved in order to obtain high quality image.

For instance, the Japanese Patent Application Laid-Open No. HEI 4-118245, and the Japanese Patent Application Laid-Open No. HEI 9-174884 disclose technology (hereinafter referred to as prior art 2). Such the technology is that it causes gradation of image to be realized according to number of ink-drops adhering to recording medium. One dot is formed while causing minute ink-drop to adhere to the same position on the recording medium or the neighboring area thereof. Such the minute ink-drop is small in comparison with standard resolution or recording resolution.

Further, the Japanese Patent Application Laid-Open No. HEI 4-361055 discloses technology (hereinafter referred to as prior art 3). Such the technology is that it causes gradation recording to be realized while forming one pixel in such a way of causing ink-drop with different volume to adhere to approximately same position repeatedly in plural scanning due to the fact that it causes a plurality of nozzles whose volume of discharging ink-drops are different to be provided.

Furthermore, the Japanese Patent Application Laid-Open No. HEI 9-164706 discloses technology (hereinafter referred to as prior art 4). Such the technology is that it causes point whose dot diameter is different to be formed at the same position on the recording medium by only one time scanning, while causing a plurality of nozzles with different nozzle diameter to be provided by plural rows.

Moreover, the Japanese Patent Application Laid-Open No. HEI 10-81012 discloses technology (hereinafter referred to as prior art 5). Such the technology is that it causes gradation recording to be realized while forming dot with different diameter on the recording medium. The technology causes the drive-voltage-waveform signal outputted in every one-printing period to be constituted from the first pulse causing ink-drop of medium dot to be discharged, the second pulse causing ink-drop of small dot to be discharged, the third pulse causing ink-drop of large dot to be discharged, and the fourth pulse giving infinitesimal vibration to meniscus. The gradation recording is realized while forming dot with different diameter on the recording medium due to the fact that it causes any one or a plurality of pulses from among the first to the fourth pulses to be selected on the basis of the gradation value.

Still moreover, the Japanese Patent Application Laid-Open No. HEI 9-11457 discloses technology (hereinafter referred to as prior art 6). Such the technology includes a common waveform generator for generating total four drive-voltage-waveforms in the case where dots with three different sizes are formed and the case where the ink is not discharged, a storage means for storing therein multi-value of print data while converting into one prescribed output, a signal processor for signal processing output from the storage means by prescribed system, and a multiplexer for applying one of four kinds of drive-voltage-waveform signals to an piezoelectric actuator while causing one of four transfer gates to conduct according to control signal causing the output of the signal processor to be level conversion. These operation realize the gradation recording.

However, there are following problems in the above-described respective prior arts.

Namely, the conventional example of the ink-jet recording head shown in FIGS. 1 to 3 has the problem that recording time becomes long. Because, it is necessary to cause the same pixel position to be scanned repeatedly by plural times while changing the drive-waveform signal in order to implement gradation recording.

Further, the prior art 2 has the problem that it causes recording picture quality to be deteriorated because the prior art 2 scans one pixel position repeatedly so that cockling, bold line, bleeding and so forth are easy to occur.

Furthermore, with respect to the prior arts 3, and 4, there are provided nozzles in accordance with gradation number in order to reduce scanning number. There is the problem that parts such as the piezoelectric actuator and so forth are needed in every respective nozzles so that the ink-jet recording head becomes large size, and price becomes high.

Moreover, the prior art 5 has the problem that construction of the nozzle and the ink chamber becomes complicated and becomes large-sized because it causes the ink-drop with different discharging quantity to be discharged from the same nozzle with the very short time period of one-printing period by a plurality of times. There is also the problem that when the number of gradation increases, it becomes difficult to introduce a plurality of drive-waveforms within one recording period, thus the recording picture quality deteriorates.

Still moreover, the prior art 6 causes common drive-waveform generator always to output the drive-waveform signal in accordance with the number of gradation. When the transfer gate selects one of the drive-waveform signals before giving to the piezoelectric actuator, it enables the dot with required size to be discharged for the recording medium by one time of scanning. However, when the number of the gradation increases, many corresponding drive-waveform signals to be generated are needed. The transfer gates are needed to provide in accordance with the number of the gradation. Thus, there is the problem that the constitution of the ink-jet recording head becomes complicated, and that the structure thereof becomes large-sized, and that the price thereof becomes high price.

SUMMARY OF THE INVENTION

In view of the foregoing, it is an object of the present invention, in order to overcome the above-mentioned problems, to provide a drive method and a drive of an ink-jet recording head which enables recording speed to be improved widely with the exception that it causes constitution of an ink-jet recording head to be complicated and that it causes constitution of an ink-jet recording head to be large size. It is capable of realizing high quality recording with the exception that even though the number of gradation increases, the recording time is not extended.

According to a first aspect of the invention, in order to achieve the above mentioned object, there is provided a drive method of an ink-jet recording head of a drive of an inkjet recording head including a plurality of ink chamber in which ink is filled, a plurality of nozzles provided for the ink chamber, from which nozzles the ink is discharged, and a vibration generation means provided for respective ink chambers while corresponding thereto for the sake of generation of pressure change on the inside of the ink chamber, which comprises the processes of a process for causing the ink-jet recording head to be scanned relatively with respective to a recording medium, a process for dividing one-printing period into a plurality of segments, a drive-waveform generation process for generating plural kinds of drive-waveform in accordance with size of an ink-drop in every segment, and a drive-waveform supply process for supplying selected the drive-waveform to the vibration generation means in every respective segments while selecting the drive-waveform in accordance with printing condition from among plural kinds of the drive-waveforms in every segments.

As described above, according to the first aspect, since plural kinds of drive-waveforms are generated in every segment which is constituted in such a way of causing one-printing period to be divided into a plurality of segments, it becomes possible to perform print of a lot of gradations during the one-printing period according to the number of kinds of the drive-waveform in accordance with the product of the number of the drive-waveform and the number of the segment. Consequently, it becomes possible to obtain high quality of printing image without extending printing time.

According to a second aspect of the present invention, in the first aspect, there is provided a drive method of an ink-jet recording head, wherein the drive-waveform includes a drive-waveform giving infinitesimal vibration to the ink existing in the ink chamber without discharging the ink from the nozzle.

As described-above, according to the second aspect, it causes vibration to be given to the ink chamber even though when the nozzle does not discharge the ink, thus, it is capable of preventing non-discharging and/or bad-discharging caused by increase of viscosity of the ink within the ink chamber.

According to a third aspect of the present invention, in the first aspect, there is provided a drive method of an ink-jet recording head, wherein there is optionally provided a drive-waveform interruption process for interrupting supply of the drive-waveform for either the drive-waveform supply process or the vibration generation means after the drive-waveform generation process.

As described-above, according to the third aspect, the drive-waveform interruption process interrupts supply of the drive-waveform to the drive-waveform supply process or the vibration generation means, thus it is capable of materializing "0" gradation while interrupting discharging of the ink-drop.

According to a fourth aspect of the present invention, in any of the first to the third aspect, there is provided a drive method of an ink-jet recording head, wherein it causes the drive-waveform, the number of kinds of the drive-waveform, time of division in the one-printing period and the number of the segment, and supply or interruption of the drive-waveform to be set in accordance with the printing condition.

As described-above, according to the fourth aspect, it is capable of implementing the print under the optimum condition in accordance with the print condition while determining kind of the drive-waveform, the number of division of the one-printing period according to various conditions on the occasion of the above-described print. According to the conditions, it is capable of dividing the one-printing period into more than three, thus it becomes possible to materialize a lot of gradations during the one-printing period due to the fact that it causes the divided one-printing period to be combined with the plural kinds of the drive-waveforms.

According to a fifth aspect of the present invention, there is provided a drive of an ink-jet recording head including a plurality of ink chamber in which ink is filled, a plurality of nozzles provided for the ink chamber, from which nozzles the ink is discharged, and a vibration generation means provided for respective the ink chambers while corresponding thereto for the sake of generation of pressure change on the inside of the ink chamber, in which the drive of the inkjet recording head executes printing on recording medium while scanning the recording medium, which comprises a dividing means for dividing one-printing period into a plurality of segments, a plurality of waveform generation means which are provided in accordance with size of respective ink-drops, for generating the drive-waveform in every respective segments which are divided by the dividing means, a switch means which is provided at a signal line for connecting respective waveform generation means with the vibration generation means, for switching ON/OFF of drive-waveform supplied from the waveform generation means, and a switching means for switching ON/OFF of the switch means in order to supply selected drive-waveform to the vibration generation means while selecting the drive-waveform in accordance with printing condition from among the whole drive-waveforms supplied during the one-printing period.

As described-above, according to the fifth aspect, since plural kinds of drive-waveforms are generated in every segment which is constituted in such a way of causing one-printing period to be divided into a plurality of segments, it becomes possible to perform print of a lot of gradations during the one-printing period according to the number of kinds of the drive-waveform in accordance with the product of the number of the drive-waveform and the number of the segment.

According to a sixth aspect of the present invention, in the fifth aspect, there is provided a drive of an ink-jet recording head, wherein the drive-waveform includes a drive-waveform giving infinitesimal vibration to the ink existing in the ink chamber without discharging the ink from the nozzle.

As described-above, according to the sixth aspect, it causes vibration to be given to the ink chamber even though when the nozzle does not discharge the ink, thus, it is capable of preventing non-discharging and/or bad-discharging caused by increase of viscosity of the ink within the ink chamber.

According to a seventh aspect of the present invention, in the fifth or the sixth aspect, there is provided a drive of an inkjet recording head, wherein it causes the drive-waveform, the number of kinds of the drive-waveform, time of division in the one-printing period and the number of the segment, and ON/OFF of the switch means to be set in accordance with the printing condition.

As described-above, according to the seventh aspect, it is capable of implementing the print under the optimum condition in accordance with the print condition while determining kind of the drive-waveform, the number of division of the one-printing period according to various conditions on the occasion of the above-described print. According to the conditions, it is capable of dividing the one-printing period into more than three, thus it becomes possible to materialize a lot of gradations during the one-printing period due to the fact that it causes the divided one-printing period to be combined with the plural kinds of the drive-waveforms.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

BRIEF DESCRIPTION OF THE DRAWINGS

FIG. 7 is an outline plan view showing the ink-jet recording head in the first embodiment;

FIGS. 8A, 8B, 8C are graphs showing three of six kinds of drive-voltage-waveforms generated in three waveform generation circuit;

FIG. 13 is a table showing combination of switching of switch for forming respective kinds of dots due to combination of the drive-voltage-waveform from the waveform generation circuit;

FIG. 22 is a table showing gradation value which is formed due to combination of switching of ON, OFF of the switch;

DETAILED DESCRIPTION OF THE PREFERRED EMBODIMENTS

A preferred embodiment of a drive method and a drive of an ink-jet recording head of the present invention will now be described in detail in accordance with the accompanying drawings.

[First Embodiment]

Figure 6:
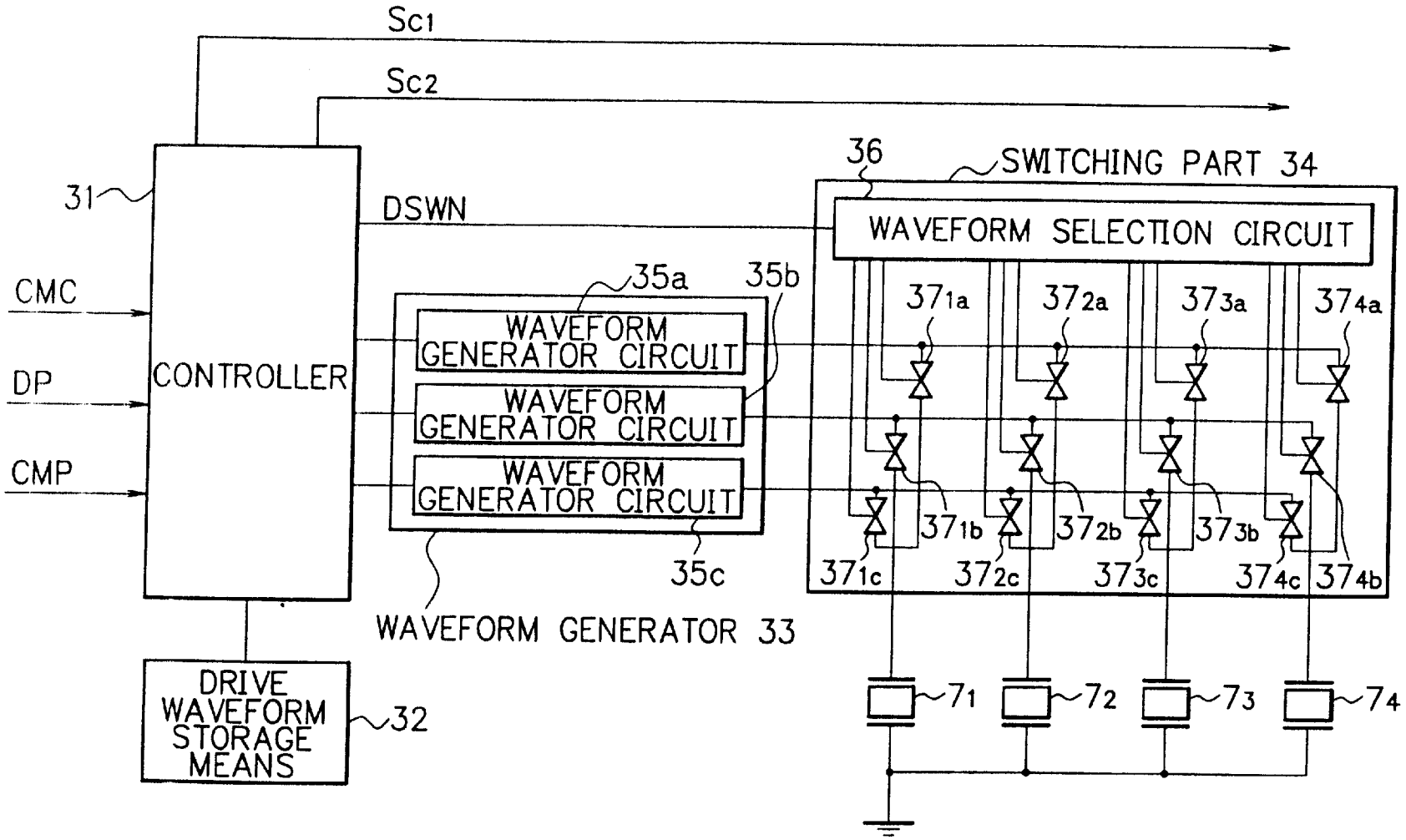
FIG. 6 is a block diagram explaining constitution of the drive of the ink-jet recording head according to a first embodiment of the present invention.

FIG. 6 is a block diagram explaining constitution of a drive of an ink-jet recording head according to a first embodiment of the present invention. FIG. 7 is an outline plan view showing the ink-jet recording head in the embodiment.

As shown in FIG. 7, there are provided four nozzles $\mathbf{2}_1$, $\mathbf{2}_2$, $\mathbf{2}_3$, $\mathbf{2}_4$ in the direction of vertical scanning (Y-axis direction) with equivalent interval in the ink-jet recording head 1 concerning this embodiment. The ink-jet recording head 1 executes recording to recording medium (recording paper) which is not illustrated. The recording is executed in such a way that it causes the ink-jet recording head 1 to be scanned relatively in the direction of horizontal scanning (X-axis direction) to the recording medium. On this occasion, it is suitable of causing the ink-jet recording head 1 to be moved while fixing the recording medium. Also, it is suitable of causing the recording medium to be moved while fixing the ink-jet recording head 1. It is suitable that the recording medium is arranged horizontally. However, if it is capable of scanning the ink-jet recording head 1 along the surface of the recording medium relatively, any arranged attitude of the recording medium is allowed.

Figure 1:
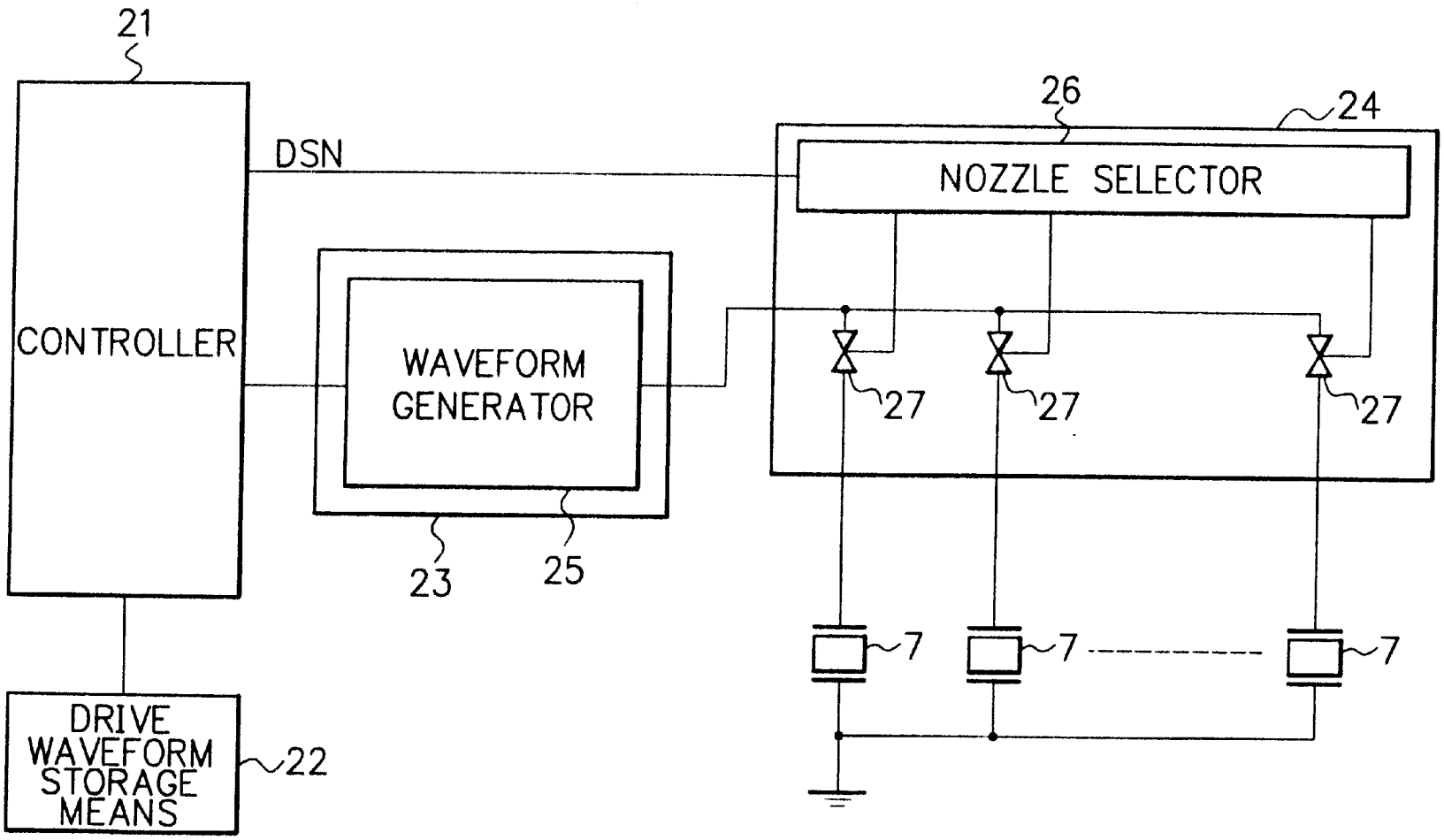
FIG. 1 PRIOR ART
FIG. 1 is a block diagram showing a drive of an ink-jet recording head according to the conventional example of the present invention.
Figure 2:
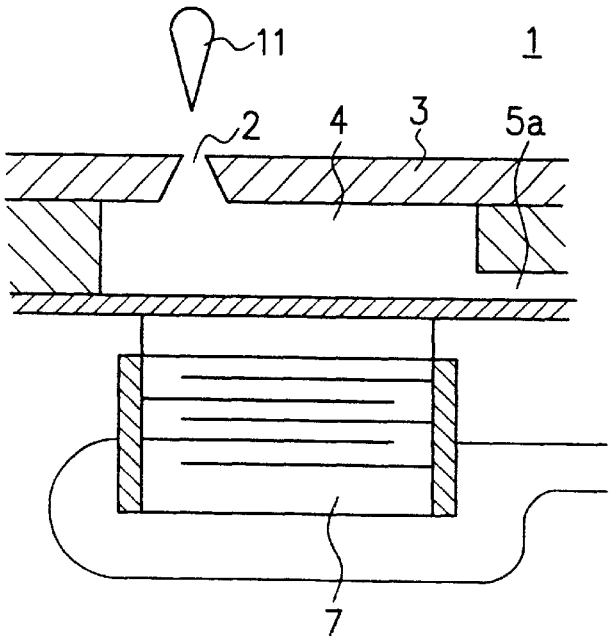
FIG. 2 PRIOR ART
FIG. 2 is a sectional outline view for explaining constitution of the ink-jet recording head of the conventional example.
Figure 3:
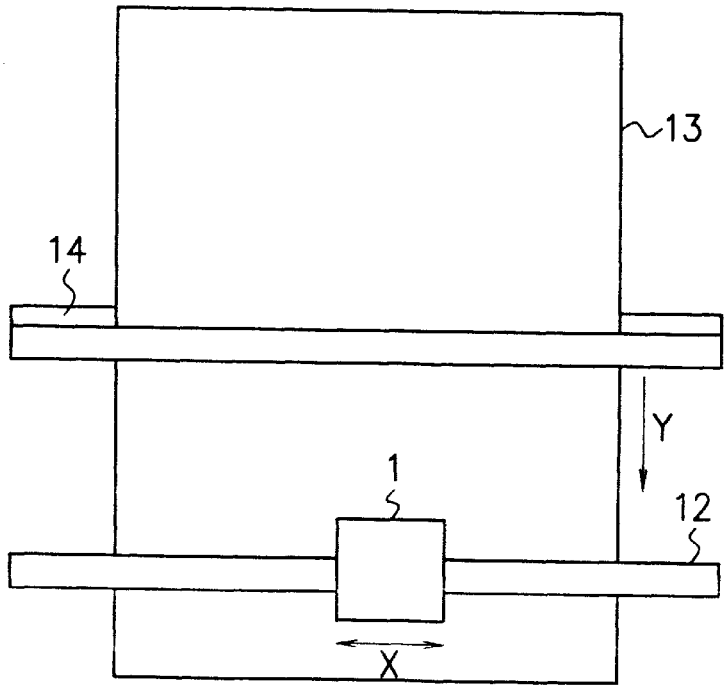
FIG. 3 PRIOR ART
FIG. 3 is an outline plan view showing relationship between a recording medium and the ink-jet recording head in an ink-jet printer.
Figure 4:
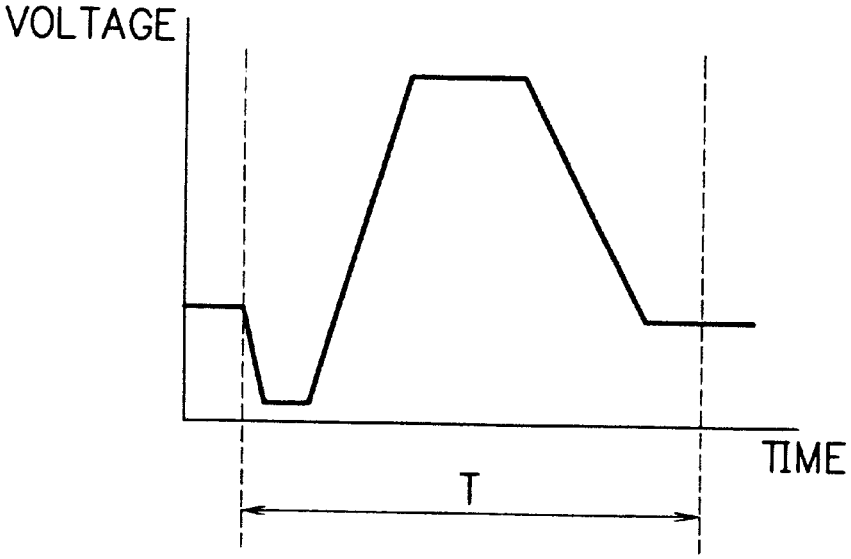
FIG. 4 PRIOR ART
FIG. 4 is a graph showing one example of drive-voltage-waveform which is supplied to an actuator during one-printing period according to the conventional example.
Figure 5:
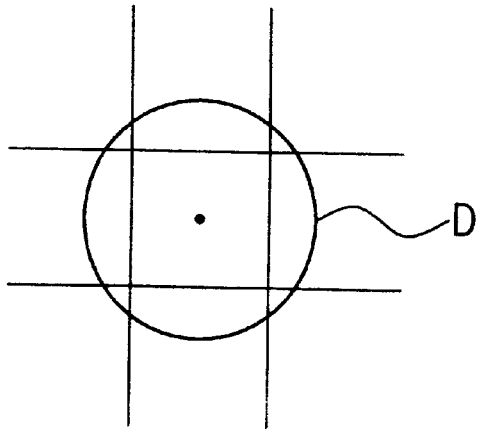
FIG. 5 PRIOR ART
FIG. 5 is view showing a dot which is formed according to drive-voltage-waveform of FIG. 4.

Further, about the device constitution for discharging the ink-drop from respective nozzles $\mathbf{2}_1$, $\mathbf{2}_2$, $\mathbf{2}_3$, $\mathbf{2}_4$ is the same as that shown in FIGS. 2, 3. Consequently, detailed explanation is omitted while adding the same signs to the same part.

Furthermore, the number of nozzle 2 is not restricted to four. It is suitable that the number of nozzle 2 is less than three. Also, it is suitable that the number of nozzle is more than five. With respect to the pitch of the nozzles $\mathbf{2}_1$, $\mathbf{2}_2$, $\mathbf{2}_3$, $\mathbf{2}_4$, it is capable of selecting any pitch with the exception of the above described matter.

Moreover, it is suitable that discharging of the ink-drop of the nozzles $\mathbf{2}_1$, $\mathbf{2}_2$, $\mathbf{2}_3$, $\mathbf{2}_4$, is executed only when the ink-jet recording head 1 moves from the left side to the right side of FIG. 3 from the initial position. While conversely, it is also suitable that discharging of the ink-drop of the nozzles $\mathbf{2}_1$, $\mathbf{2}_2$, $\mathbf{2}_3$, $\mathbf{2}_4$, is executed only when the ink-jet recording head 1 moves from the right side to the left side of FIG. 3 from the initial position. According to this constitution, there is the merit that it is capable of executing the gradation recording with more high speed.

As shown in FIG. 6, the driving of the ink-jet recording head consists of a waveform generator 33 for generating drive-voltage-waveform to be plural kinds of drive-waveform, a drive-waveform storage means 32 in which information concerning voltage-waveform generated from the waveform generator 33 is stored therein beforehand, a switching part 34 for switching the drive-voltage-waveform to be supplied to actuators $\mathbf{7}_1$, $\mathbf{7}_2$, $\mathbf{7}_3$, $\mathbf{7}_4$, corresponding to respective nozzles $\mathbf{2}_1$, $\mathbf{2}_2$, $\mathbf{2}_3$, $\mathbf{2}_4$, and a controller 31 for controlling of drive among the respective parts and transfer of the signal.

[Waveform Generator 33]

The waveform generator 33 has three waveform generation circuits 35*a*, 35*b*, and 35*c*, in order to generate plural kinds (6 kinds of drive-voltage-waveforms in this embodiment) of the drive-voltage-waveforms. Respective power amplifiers (not illustrated) are connected to the waveform generation circuits 35*a*, 35*b*, and 35*c*. The waveform generation circuits 35*a*, 35*b*, and 35*c* generate drive-voltage-waveform signals. The power amplifiers increase or decrease applied voltage on the basis of the drive-voltage-waveform signal. The power amplifiers supply the drive voltage to the switching part 34. The waveform generation circuits 35*a*, 35*b*, and 35*c* generate the drive-voltage-waveform according to pattern stored in the drive-waveform storage means 32 beforehand.

[Drive-voltage-waveform Storage Means 32]

The drive-voltage-waveform storage means 32 is constituted by storage means such as ROM (read only memory), RAM (random access memory), FD (flexible disk), or HDD (hard disk). The drive-voltage-waveform storage means 32 stores therein information for forming drive-voltage-waveform which is prepared beforehand according to various kinds of printing establishment. The information described above is read out by the controller 31 to be sent to the waveform generator 33.

[Switching Part 34]

The respective waveform generation circuits 35*a*, 35*b*, and 35*c* are connected to the actuators $7_1$, $7_2$, $7_3$, and $7_4$ corresponding to the nozzles $2_1$, $2_2$, $2_3$, and $2_4$ by signal lines. There are provided total 12 switches $37_{1a}$, . . . $37_{4c}$ between the signal lines and the actuators $7_1$, $7_2$, $7_3$, and $7_4$ in order to supply one of prescribed drive-voltage-waveforms generated by the waveform generation circuits 35*a*, 35*b*, and 35*c* to the actuators $7_1$, $7_2$, $7_3$, and $7_4$.

For instance, it causes arbitrary actuator (for instance actuators $7_2$, $7_3$) to be driven from among the actuators 7 according to the drive-voltage-waveform generated from the waveform generation circuit 35*b*. On this occasion, it is suitable of causing the switches $37_{2b}$, and $37_{3b}$ to be turned ON, and it is suitable of causing remaining switches $37_{1a}$, . . . $37_{4c}$ to be turned OFF. The waveform selection circuit 36 executes switching of ON/OFF of the switches $37_{1a}$,. . . $37_{4c}$ on the basis of command signal DSWN from the controller 31.

The command signal DSWN is constituted from 3-bit parallel data. The switching of the switches $37_{1a}$, . . . $37_{4c}$ is performed using the 3-bit parallel data consisting of "0" and "1". For instance, it causes the whole switches $37_{1a}$, $37_{1b}$, and $37_{1c}$ corresponding to the actuator $7_1$ to be turned OFF On this occasion, "0 0 0" of DSWN signal is transmitted from the controller 31 to the waveform selection circuit 36. It causes the switch $37_{1a}$ to be turned ON due to the fact that "1 0 0" of the DSWN signal is transmitted from the controller 31 to the waveform selection circuit 36. It causes the switch $37_{1b}$ to be turned ON due to the fact that "0 1 0" of the DSWN signal is transmitted from the controller 31 to the waveform selection circuit 36. It causes the switch $37_{1c}$ to be turned ON due to the fact that "0 0 0" of the DSWN signal is transmitted from the controller 31 to the waveform selection circuit 36. Further, about another actuators $7_2$, $7_3$, and $7_4$, whose operation is the same as that of the actuator $7_1$.

Switching operation of the switches $37_{1a}$, . . . $37_{4c}$ causes the data supplied to be maintained, and latch signal (self-holding signal) causes state of the switch to be determined.

The latch signal is generated in accordance with division number (2, in this embodiment) of printing period T. The first latch signal is generated in accordance with discharging start command. It causes any one of the switches $37_{1a}$, . . . $37_{4c}$ to be state of the first waveform selection. The second latch signal is generated in accordance with timing of the switching, thus causing any one of the switches $37_{1a}$, . . . $37_{4c}$ to be state of the second waveform selection.

[Controller 31]

The controller 31 outputs, for instance, drive command signal SC1 of a drive motor for moving the ink-jet recording head 1, and drive command signal SC2 of a drive motor for rotating feed roller 14, in accordance with control command signal CMC supplied from an external part.

Further, the controller 31 transmits the command signal DSWN to the waveform selection circuit 36 for switching the switches $37_{1a}$, . . . $37_{4c}$. The controller 31 judges whether it causes any one of prescribed drive-voltage-waveforms generated by three waveform generation circuits 35*a*, 35*b*, and 35*c* to be supplied or it causes none of prescribed drive-voltage-waveforms generated by three waveform generation circuits 35*a*, 35*b*, and 35*c* to be supplied toward four actuators $7_1$, $7_2$, $7_3$, and $7_4$ according to printing data DP including the gradation information supplied from the external part.

Furthermore, when the printing start command CMP is supplied from the external part in every horizontal scanning, the controller 31 supplies necessary number of times of discharging start command signal to the waveform generator 33. Further, the number of times of the drive-waveform information and the read-out data read out from the drive-waveform storage means 32 beforehand, and the number of times of switching implemented in every one printing period T (the number of times for generating the latch signal, which equals the number of time of division in every one printing period) are determined according to printing mode such as high speed printing mode, high picture quality printing mode, and so forth to be supplied to the controller 31 from the external part.

[Shape of Drive-voltage-waveform]

Figure 9A:
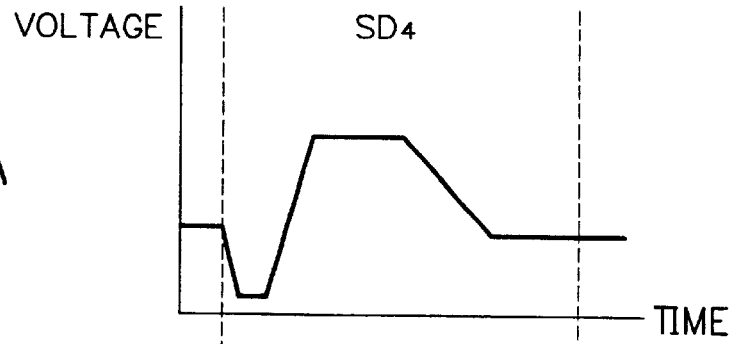
FIGS. 9A, 9B, 9C are graphs showing remaining three of six kinds of drive-voltage-waveforms generated in three waveform generation circuit.
Figure 9B:
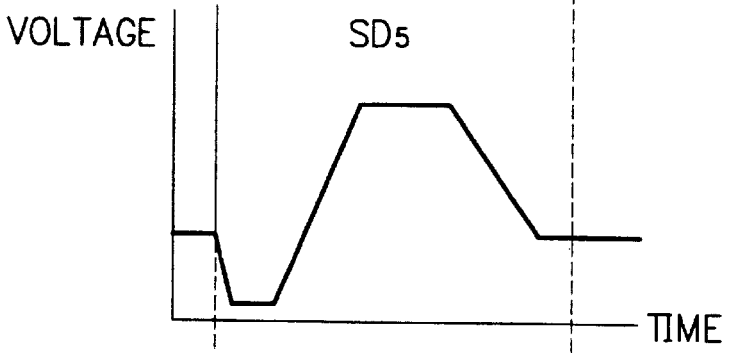
Figure 9C:
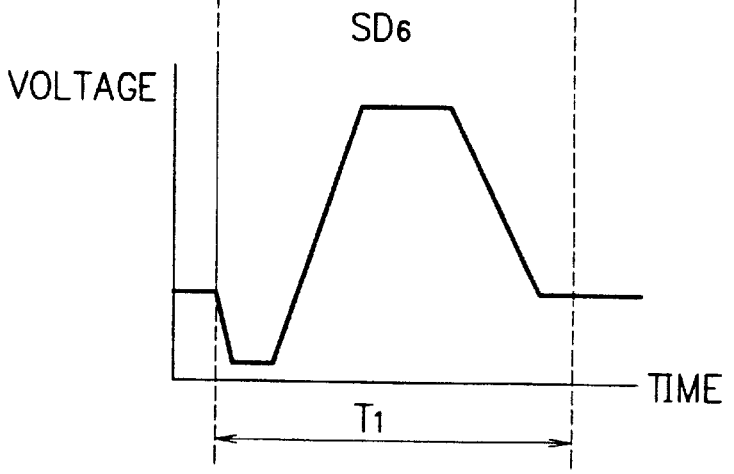
Figure 10A:
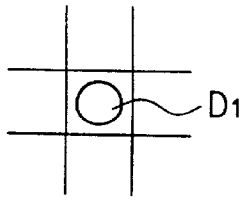
FIGS. 10A, 10B, 10C are views showing dots formed by the drive-voltage-waveform of FIGS. 8A, 8B, 8C, and dots of FIGS. 10A, 10B, 10C correspond to respective FIGS. 8A, 8B, 8C, of drive-voltage-waveform.
Figure 10B:
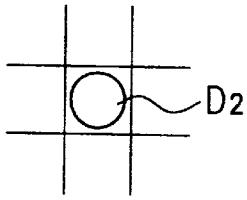
Figure 10C:
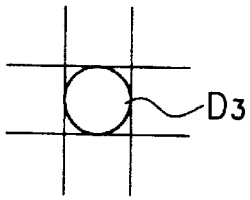
Figure 11A:
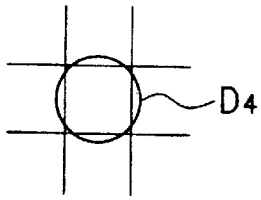
FIGS. 11A, 11B, 11C are views showing dots formed, by the drive-voltage-waveform of FIGS. 9A, 9B, 9C, and dots of FIGS. 11A, 11B, 11C correspond to respective FIGS. 9A, 9B, 9C, of drive-voltage-waveform.
Figure 11B:
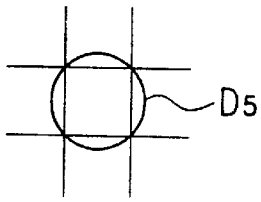
Figure 11C:
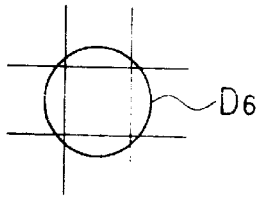

FIGS. 8A, 8B, 8C are graphs showing three of six kinds of drive-voltage-waveforms generated in three waveform generation circuit 35A, 35B, and 35C. FIGS. 9A, 9B, 9C are graphs showing remaining three of six kinds of drive-voltage-waveforms generated in three waveform generation circuit 35A, 35B, and 35C. FIGS. 10A, 10B, 10C are views showing dots formed by the drive-voltage-waveform of FIGS. 8A, 8B, 8C, and dots D1 to D3 of FIGS. 10A, 10B, 10C correspond to respective FIGS. 8A, 8B, 8C, of drive-voltage-waveform. FIGS. 11A, 11B, 11C are views showing dots formed by the drive-voltage-waveform of FIGS. 9A, 9B, 9C, and dots D4 to D6 of FIGS. 11A, 11B, 11C correspond to respective FIGS. 9A, 9B, 9C, of drive-voltage-waveform.

[Printing Procedure]

There will be described printing procedure for the recording medium according to drive method of the ink-jet recording head in this embodiment.

Figure 12A:
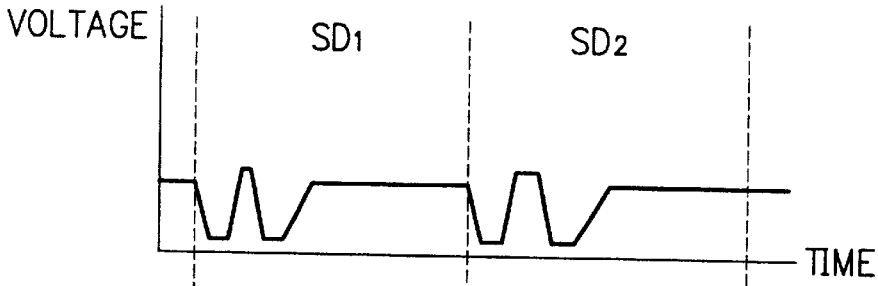
FIGS. 12A, 12B, 12C are graphs showing the drive-voltage-waveform generated by three waveform generation circuit during one-printing period.
Figure 12B:
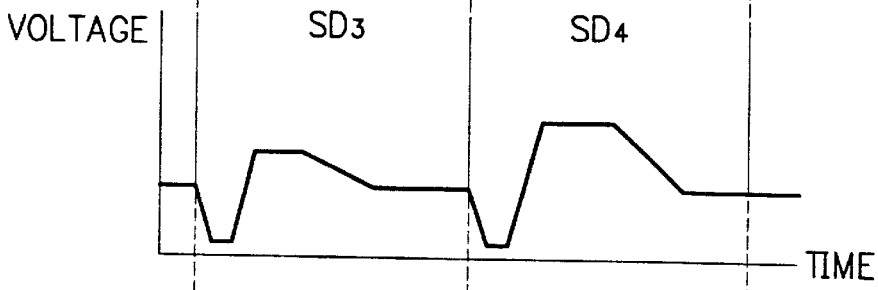
Figure 12C:
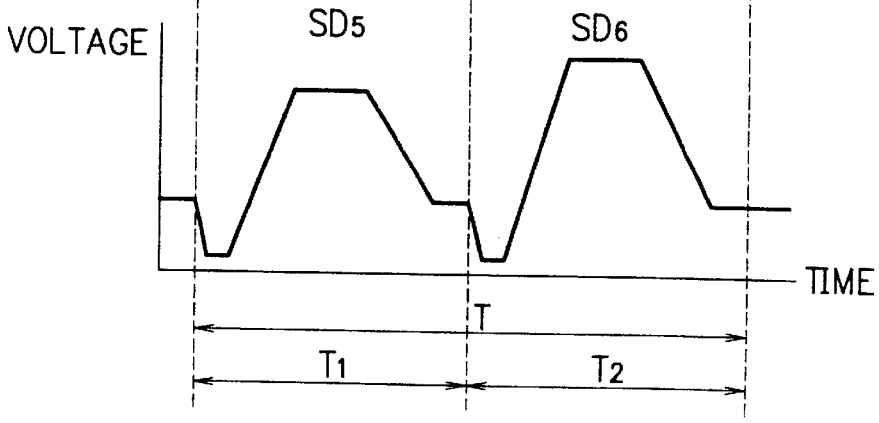
Figures 14A, 14B, 14C, 14D:
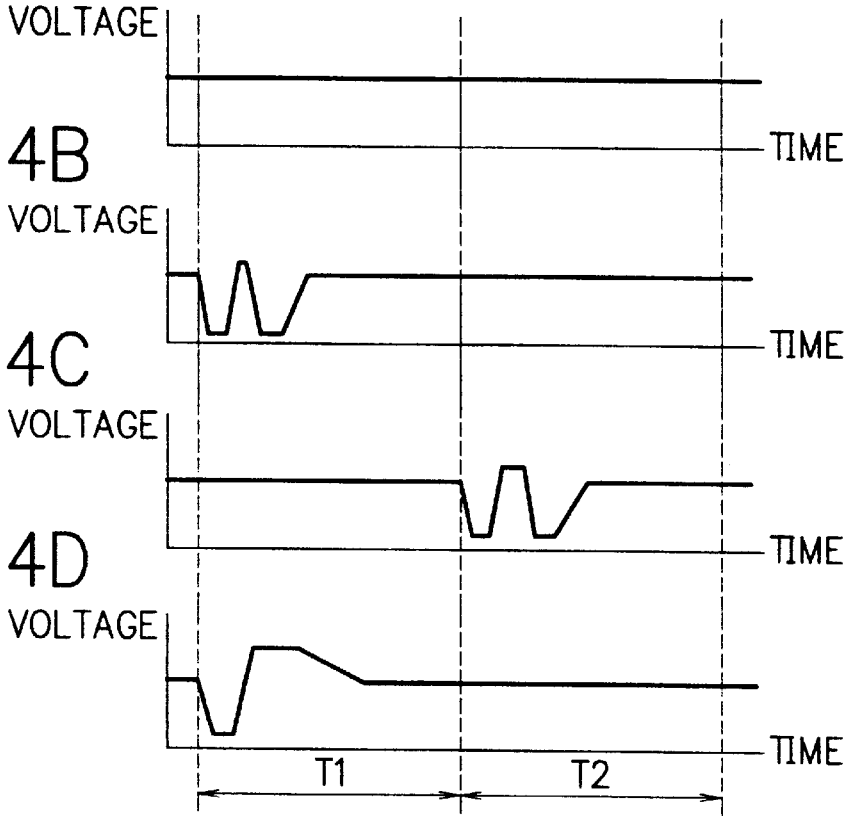
FIGS. 14A, 14B, 14C, 14D are graphs showing the drive-voltage-waveform provided for the actuator according to combination of the switch in accordance with the table of FIG. 13 and FIGS. 14A, 14B, 14C, 14D correspond to respective gradation values 0 to 3 of FIG. 13.

FIGS. 12A, 12B, 12C are graphs showing the drive-voltage-waveform generated by three waveform generation circuits 35A, 35B, and 35C during one printing period.

The controller 31 inputs therein that the number of times of waveform selection in the one printing period is two times from the external part beforehand. Namely, as shown in FIGS. 12A, 12B, 12C, in the one printing period, the waveform generation circuit 35*a* generates the drive-voltage-waveforms SD1, and SD2 shown in FIGS. 8A, 8B, the waveform generation circuit 35*b* generates the drive-voltage-waveforms SD3, and SD4 shown in FIGS. 8C, 9A, and the waveform generation circuit 35*c* generates the drive-voltage-waveforms SD5, and SD6 shown in FIGS. 9C, 9D.

It is necessary to combine suitably six drive-voltage-waveforms SD1 to SD6 supplied from the waveform generation circuits 35*a*, 35*b*, and 35*c* in order to generate six dots D1 to D6 by three waveform generation circuits 35*a*, 35*b*, and 35*c*. This is capable of being implemented due to the fact that it causes ON/OFF of the switches $37_{1a}$, . . . $37_{4c}$ to be switched. The switches $37_{1a}$, . . . $37_{4c}$ are provided in every respective actuators $7_1$, $7_2$, $7_3$, and $7_4$ corresponding to the respective nozzles $2_1$, $2_2$, $2_3$, and $2_4$.

Further, in the cases where the one printing period is divided into a plurality of segments, the timing of switching of ON/OFF of the above described switches $37_{1a}$, . . . $37_{4c}$ is necessary to lengthen more than maximum continuous drive frequency to be head characteristic of the ink-jet recording head. The maximum continuous drive frequency is changed according to diameter of the ink-drop discharged practically. However, in the first embodiment, and the second and the third embodiments described later, the maximum continuous frequency is set uniformly for the sake of facility of explanation.

FIG. 13 is a table showing combination of switching of the switch for forming respective kinds of dots due to combination of the drive-voltage-waveform from the waveform generation circuit. FIG. 13 shows combination of switching of the switches $\mathbf{37}_{1a}$, $\mathbf{37}_{1b}$, and $\mathbf{37}_{1c}$ of any one (for instance, actuator $\mathbf{7}_1$) of the plurality of the actuators 7. Gradation values 1 to 6 of the table of FIG. 13 correspond to respective dots D1 to D6. Further, the gradation value "0" of the table of FIG. 13 shows that it causes no ink discharging to be executed.

Figures 15A, 15B, 15C:
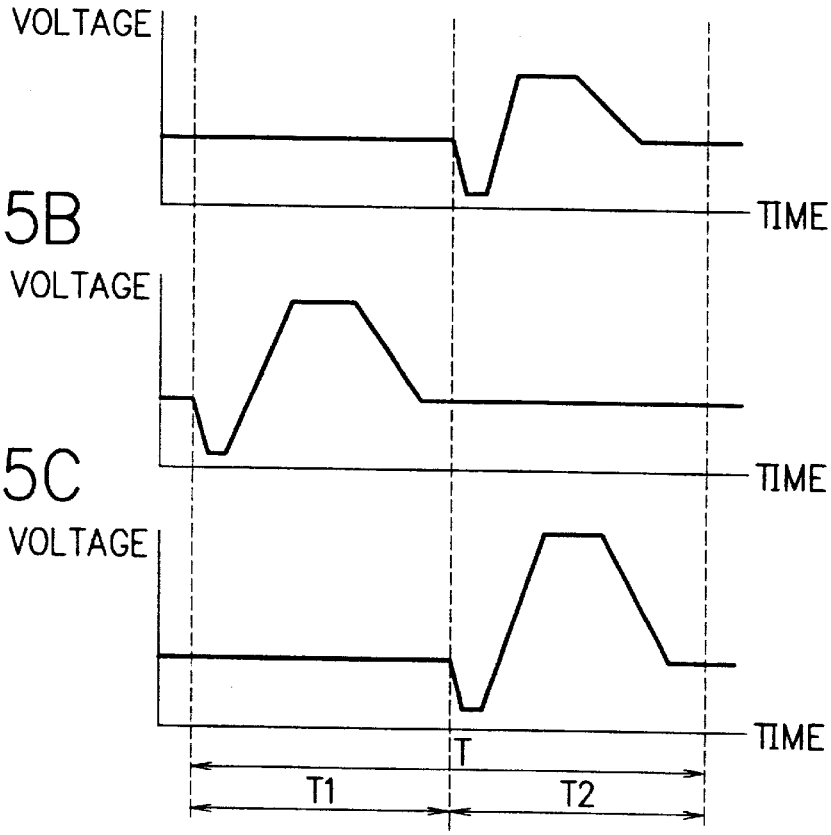
FIGS. 15A, 15B, 15C are graphs showing the drive-voltage-waveform provided for the actuator according to combination of the switch in accordance with the table of FIG. 13 and FIGS. 15A, 15B, 15C correspond to respective gradation values 4 to 6 of FIG. 13.

FIGS. 14A, 14B, 14C, 14D are graphs showing the drive-voltage-waveform provided for the actuator according to combination of the switch in accordance with the table of FIG. 13 and FIGS. 14A, 14B, 14C, 14D correspond to respective gradation values 0 to 3 of FIG. 13. FIGS. 15A, 15B, 15C are graphs showing the drive-voltage-waveform provided for the actuator according to combination of the switch in accordance with the table of FIG. 13 and FIGS. 15A, 15B, 15C correspond to respective gradation values 4 to 6 of FIG. 13.

The controller 31 reads out information concerning the drive-voltage-waveforms SD1 to SD6 shown in FIGS. 8A, 8B, and 8C, and FIGS. 9A, 9B, and 9C from the drive-voltage-waveform storage means 32 to supply the information to the waveform generator 33. According to this operation, the drive-voltage-waveforms SD1 to SD6 are supplied for the actuators $\mathbf{7}_1$, $\mathbf{7}_2$, $\mathbf{7}_3$, and $\mathbf{7}_4$ from the respective waveform generation circuits 35*a*, 35*b*, and 35*c*.

The controller 31 transmits necessary number of times of discharging start command signal to the waveform generator 33 according to the printing start command signal CMP supplied from the external part. The controller 31 supplies the command signal DSWN twice for the sake of selection of the drive-voltage-waveform/nozzle in accordance with gradation value of pixel position of the recording medium to the switching part 34 in every discharging start command in the one printing period T.

Hereinafter, there will be described the case where it causes command signal to be outputted to the arbitrary actuator $\mathbf{7}_1$. The description with respect to another actuators $\mathbf{7}_2$, $\mathbf{7}_3$, and $\mathbf{7}_4$ is omitted because the description thereof is the same as that of the actuator $\mathbf{7}_1$.

When in the gradation data on the basis of the printing data DP, the gradation value is "0", the drive-voltage-waveform signal is not supplied for the actuator $\mathbf{7}_1$. Consequently, the signal supplied for the sake of switching of the switches $\mathbf{37}_{1a}$, $\mathbf{37}_{1b}$, and $\mathbf{37}_{1c}$ corresponding to the actuator $\mathbf{7}_1$ is "0 0 0" at the first time and the second time (referring to FIG. 13, gradation value "0" of the table).

When the gradation value is "1", as is clear from the table of FIG. 13, it is suitable that it causes the drive-voltage-waveform SD1 to be supplied to the actuator $\mathbf{7}_1$. Since the waveform generation circuit 35*a* generates the drive-voltage-waveform SD1, it causes the waveform selection signal DSEW of "1 0 0" to be supplied to the switch $\mathbf{37}_{1a}$ at the first time. It causes the waveform selection signal DSEW of "0 0 0" to be supplied to the switch $\mathbf{37}_{1a}$ at the second time. According to the similar operation, it is capable of realizing seven gradations in accordance with combination of switching of the switches $\mathbf{37}_{1a}$, $\mathbf{37}_{1b}$, and $\mathbf{37}_{1c}$ in every respective number of times.

Thus, drive of respective actuators 71, 72, 73, and 74 is controlled, before the dots D1 to D6 are formed on the recording medium as shown in FIGS. 10A, 10B, and 10C, and FIGS. 11A, 11B, and 11C.

As described above, according to the embodiment, three drive-waveform signals SD1 to SD3 and the drive-waveform signals SD4 to SD6 are generated simultaneously in every one time by three drive-waveform generation circuits 35*a* to 35*c*. Since it is capable of selecting twice drive-waveform signals SD1 to SD6 in the one printing period T, it becomes possible to perform image recording of 7 gradations with one time scanning with respect to one pixel on the recording medium, thus there is the merit that it is capable of printing high quality of image with high speed.

[Second Embodiment]

Next, there will be described the second embodiment of the present invention in accordance with accompanying FIGS. 16A, 16B, 16C to 20A, 20B, 20C.

Further, the drive for executing the drive method in this embodiment is the same as that of the first embodiment. Thus, illustration and concrete description are omitted accordingly.

Figure 16A:
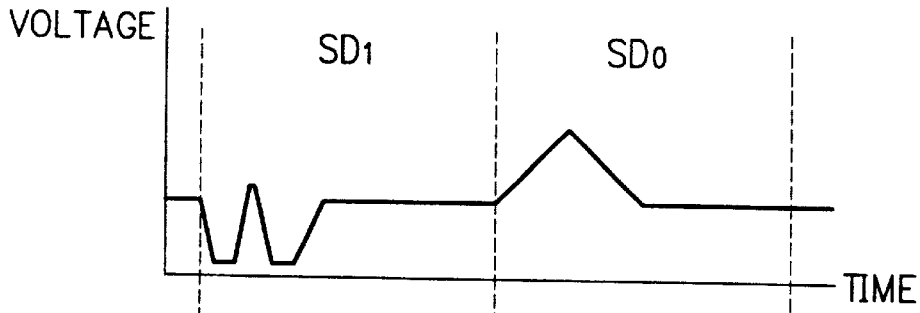
FIGS. 16A, 16B, 16C are graphs showing 6 kinds of drive-voltage-waveforms generated by three waveform generation circuits of the drive of FIG. 6 according to the second embodiment of the present invention.
Figure 16B:
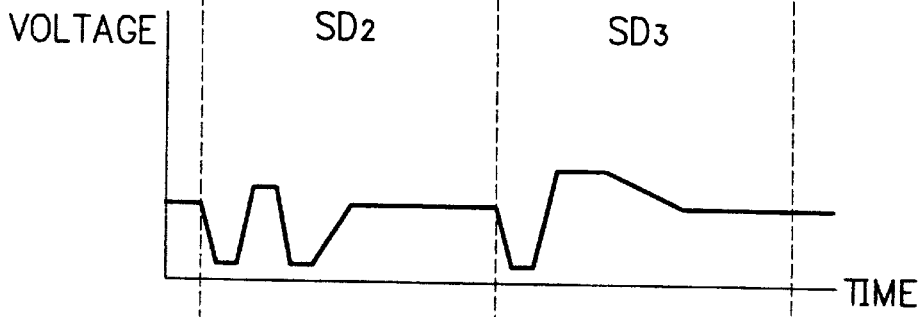
Figure 16C:
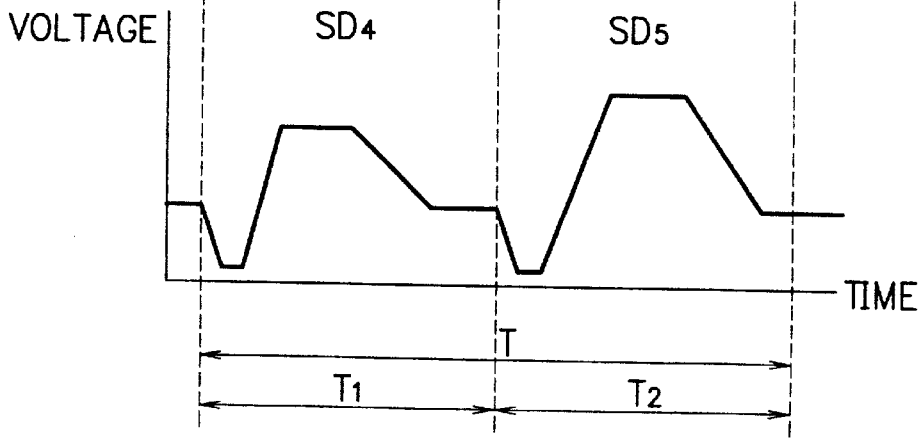

FIGS. 16A, 16B, 16C are graphs showing 6 kinds of drive-voltage-waveforms generated by three waveform generation circuits of the drive of FIG. 6 according to the second embodiment of the present invention. The drive-voltage-waveforms SD1 to SD5 of the graph are the same as the drive-voltage-waveforms SD1 to SD5 shown in FIGS. 8A, 8B, and 8C, and 9A, 9B, and 9C of the first embodiment, and the dots formed according to the drive-voltage-waveforms SD1 to SD5 correspond to respective the dots D1 to D5 shown in FIGS. 10A, 10B, and 10C, and FIGS. 11A, 11B, and 11C.

In this embodiment, the first point which is different from the first embodiment is that a drive-voltage-waveform SD0 is generated for giving infinitesimal vibration to the ink chamber 4 in the degree that it causes no ink-drop to be discharged from the nozzles $\mathbf{2}_1$, $\mathbf{2}_2$, $\mathbf{2}_3$, and $\mathbf{2}_4$.

Figures 17, 18:
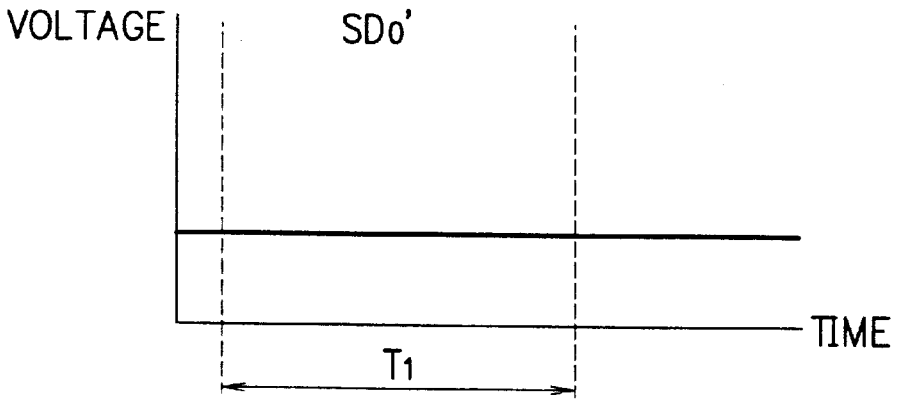
FIG. 17 is a graph showing another example of drive-voltage-waveform so as not to discharge ink-drop from the nozzle.
FIG. 18 is a table showing gradation value which is formed due to combination of switching of ON, OFF of the switch.

Further, in stead of generation of the drive-voltage-waveform SD0 of FIGS. 16A, 16B, and 16C, it is also suitable that it causes flat drive-voltage-waveform SD0' to be generated shown in FIG. 17. Such the flat drive-voltage-waveform SD0' causes the actuator 7 not to vibrate at all.

In this embodiment, one printing period T is divided into two segments $T_1$, and $T_2$. Different kinds of drive-voltage-waveforms SD1 to SD5 are generated simultaneously at the waveform generation circuits 35*a*, 35*b*, and 35*c* in every respective segments $T_1$, and $T_2$. Concretely, the waveform generation circuit 35*a* generates the drive-voltage-waveform SD0 (or SD0'), SD1. The waveform generation circuit 35*b* generates the drive-voltage-waveform SD2, SD3. The waveform generation circuit 35*c* generates the drive-voltage-waveform SD4, SD5.

Figure 19A:
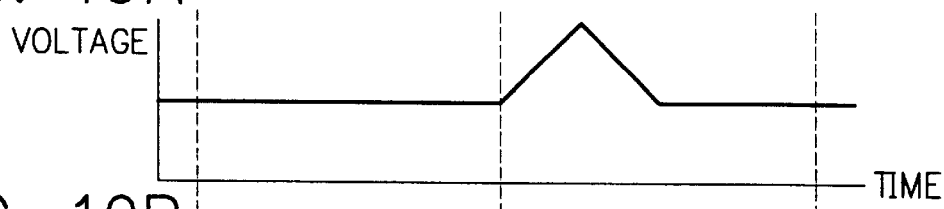
FIGS. 19A, 19B, 19C are graphs showing drive-voltage-waveform provided to the actuator according to combination of switching of the switch in accordance with FIG. 18, and FIGS. 19A, 19B, 19C correspond to the gradation values 0 to 2 of the table of FIG. 18.
Figure 19B:
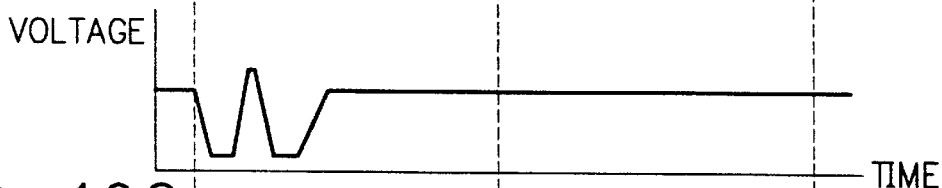
Figure 19C:
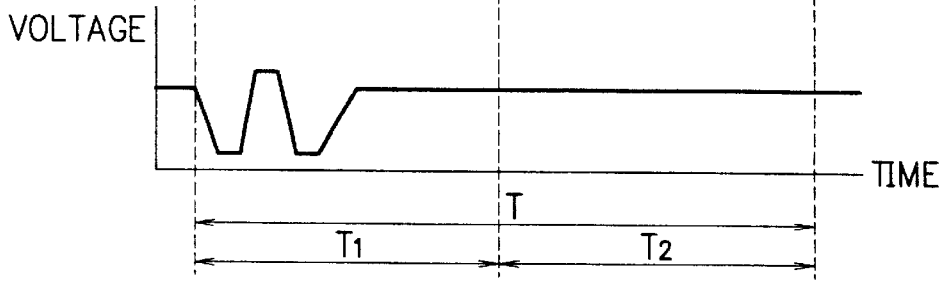
Figure 20A:
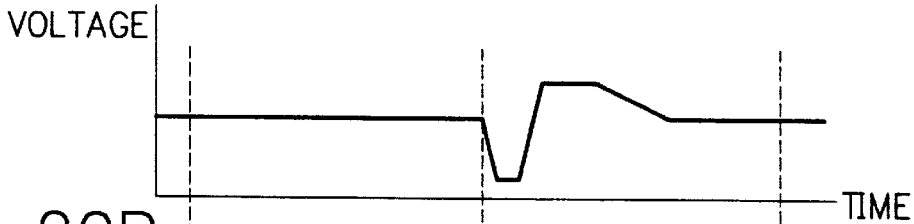
FIGS. 20A, 20B, 20C are graphs showing drive-voltage-waveform provided to the actuator according to combination of switching of the switch in accordance with FIG. 18, and FIGS. 19A, 19B, 19C correspond to the gradation values 3 to 5 of the table of FIG. 18.
Figure 20B:
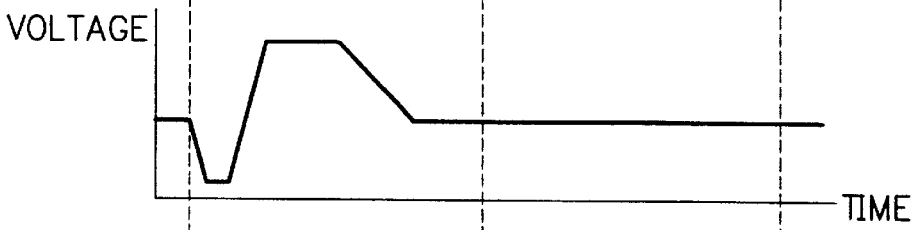
Figure 20C:
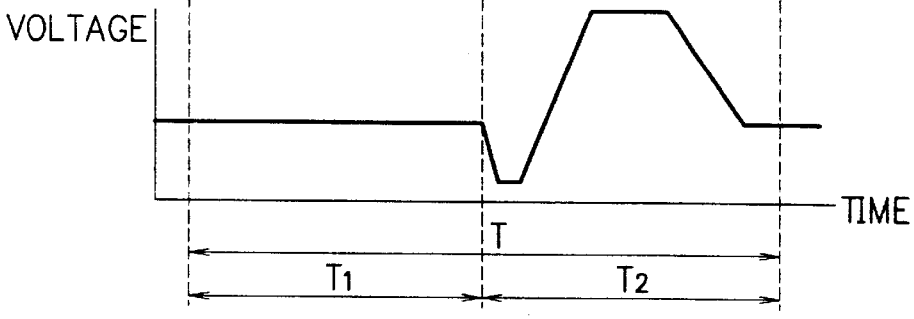

FIG. 18 is a table showing gradation value which is formed due to combination of switching of ON, OFF of the switches $\mathbf{37}_{1a}$. . . $\mathbf{37}_{4c}$. FIGS. 19A, 19B, 19C are graphs showing drive-voltage-waveform which is provided for the actuator according to combination of switching of the switch in accordance with FIG. 18, and FIGS. 19A, 19B, 19C correspond to the gradation values 0 to 2 of the table of FIG. 18. FIGS. 20A, 20B, 20C are graphs showing drive-voltage-waveform provided for the actuator according to combination of switching of the switch in accordance with FIG. 18, and FIGS. 19A, 19B, 19C correspond to the gradation values 3 to 5 of the table of FIG. 18.

Further, the gradation value "0" means that the ink-drop is not discharged.

In this embodiment, there is the second different point from the first embodiment. In the gradation data according to the printing data DP, when the gradation value is "0", it causes the signal of "0 0 0" to be supplied to the switches $37_{1a}$, $37_{1b}$, and $37_{1c}$ corresponding to the actuator $7_1$ in the first time. It causes the signal of "1 0 0" to be supplied to the switches $37_{1a}$, $37_{1b}$, and $37_{1c}$ corresponding to the actuator $7_1$ in the second time. The switch $37_{1a}$ switched into ON by the signal "1 0 0", before the drive-voltage-waveform SD0 (or SD0') is supplied to the actuator $7_1$ from the waveform generation circuit 35*a*. Consequently, the ink-drop is not discharged from the nozzle $2_1$, thus the gradation value "0" is materialized.

As the second embodiment, it is capable of preventing non-discharging or bad-discharging caused by increasing of coefficient of viscosity of the ink within the ink chamber due to the fact that it causes the drive-voltage-waveform SD0 to be given. The drive-voltage-waveform SD0 causes the ink chamber 4 to vibrate in the degree that the ink-drop is not discharged.

[Third Embodiment]

Next, there will be described the third embodiment of the present invention in accordance with FIGS. 21A, 21B, and 21C, to FIGS. 23A, 23B, 23C, and 23D.

Further, since the device for executing the drive method in the embodiment is the same as that of the first embodiment and the second embodiment, illustration and concrete explanation are omitted.

Figure 21A:
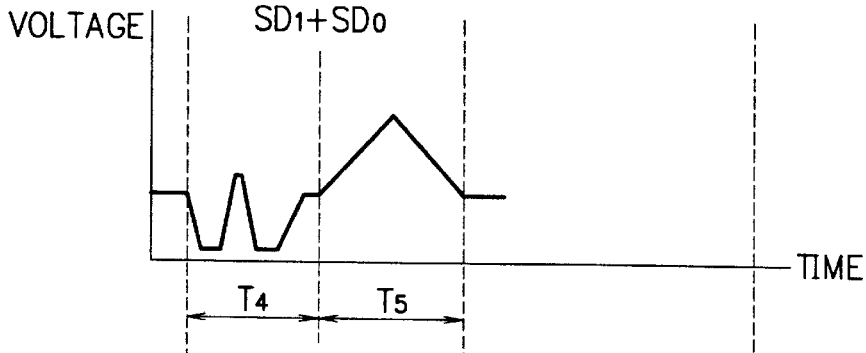
FIGS. 21A, 21B, 21C are graphs showing 4 kinds of drive-voltage-waveforms generated by three waveform generation circuits according to the third embodiment of the present invention.
Figure 21B:
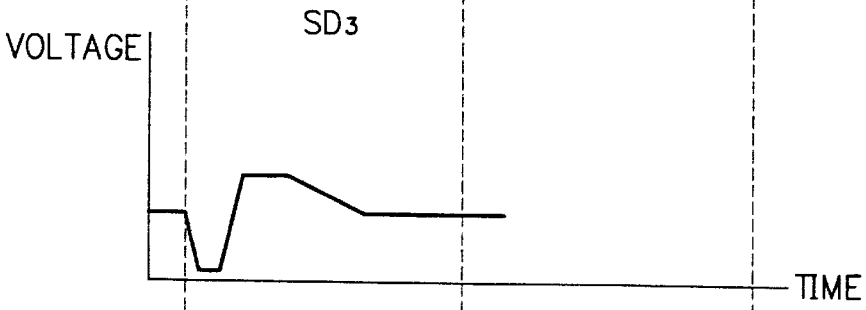
Figure 21C:
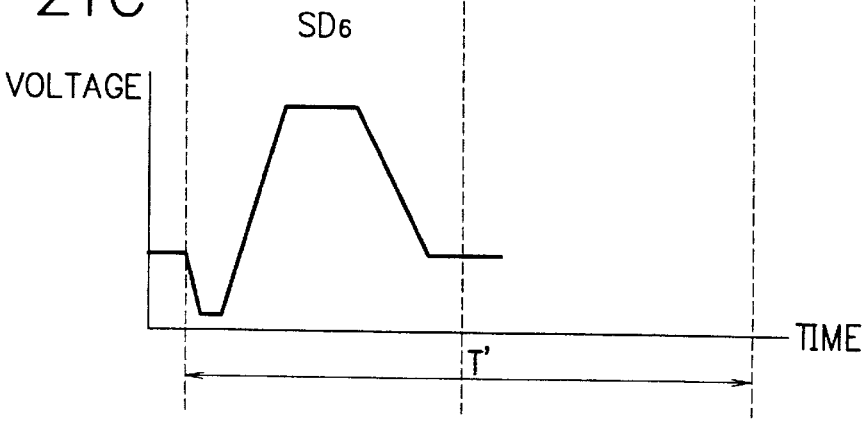
Figure 23A:
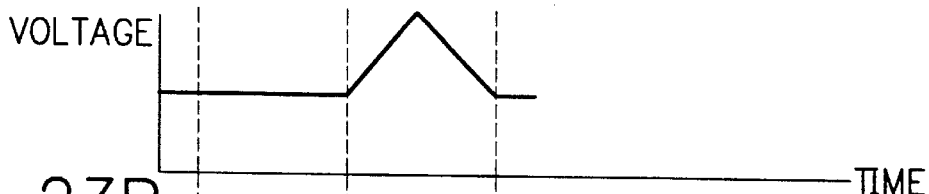
FIGS. 23A, 23B, 23C, 23D are graphs showing drive-voltage-waveform provided to the actuator according to combination of switching of the switch in accordance with FIG. 22, and FIGS. 23A, 23B, 23C, 23D correspond to the gradation values 0, 1, 3, 6 of the table of FIG. 22.
Figure 23B:
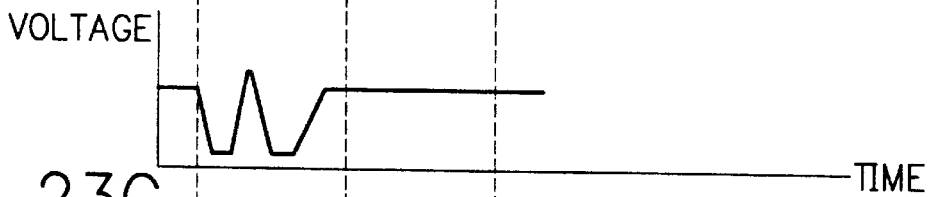
Figure 23C:
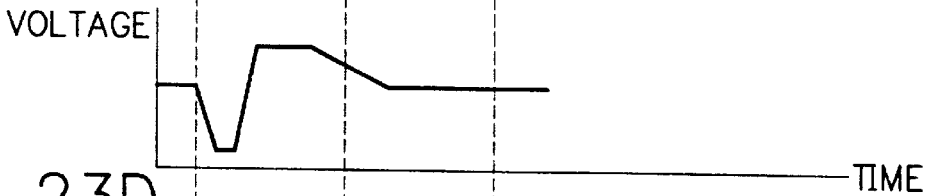
Figure 23D:
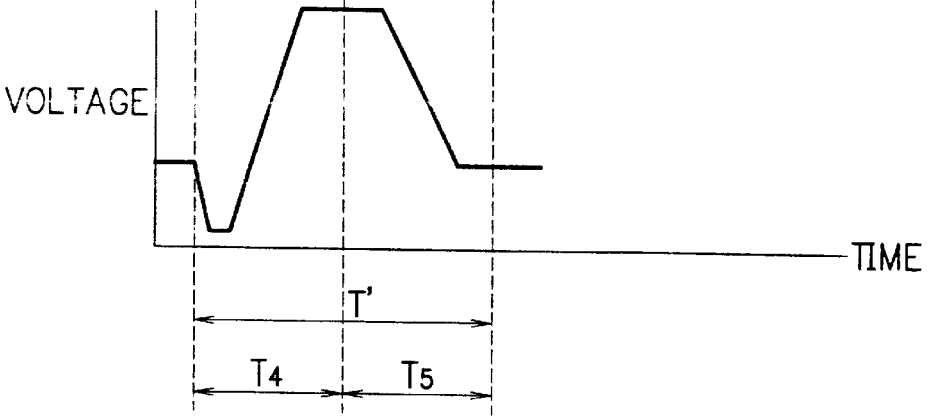

FIGS. 21A, 21B, 21C are graphs showing 4 kinds of drive-voltage-waveforms generated by three waveform generation circuits 35*a*, 35*b*, and 35*c* according to the third embodiment of the present invention. FIG. 22 is a table showing gradation value which is formed due to combination of switching of ON, OFF of the switches $37_{1a}$. . . $37_{4c}$. FIGS. 23A, 23B, 23C, 23D are graphs showing drive-voltage-waveform provided for the actuator according to combination of switching of the switch in accordance with FIG. 22, and FIGS. 23A, 23B, 23C, 23D correspond to the gradation values 0, 1, 3, 6 of the table of FIG. 22.

In the third embodiment, the drive method of the present invention is applied to high speed printing mode. Here, the high speed printing mode means that one printing period T in the third embodiment is shorter than the one printing period shown in the first and the second embodiments. For that reason, it is incapable of dividing the one printing period T into a plurality of segments. Thus, it is difficult to supply the drive-voltage-waveform in every respective segments even though it causes the one printing period T to be divided into a plurality of segments as shown in the first and the second embodiments.

Thus, in the third embodiment, as shown in FIG. 21B, the waveform generation circuit 35*b* generates the drive-voltage-waveform SD3. While, as shown in FIG. 21C, the waveform generation circuit 35*c* generates the drive-voltage-waveform SD6. Further, the drive-voltage-waveform SD1 or the drive-voltage-waveform SD0 has relatively shorter period. Thus, in the waveform generation circuit 35*a*, as shown in FIG. 21A, one side (front half of segment $T_4$) of respective segments $T_4$, $T_5$ divided into two segments generates the drive-voltage-waveform SD1, while the other side (rear half of segment $T_5$) generates the drive-voltage-waveform SD0.

As shown in the table of FIG. 22, in this embodiment, four gradation values, namely, the gradation values "0", "1", "3", and "6" are materialized according to switching of ON, OFF of the switches $37_{1a}$, . . . $37_{4c}$. These four gradation values "0", "1", "3", and "6" correspond to respective FIGS. 23A, 23B, 23C, and 23D.

In order to materialize the gradation value "0", it is suitable that it causes one printing period T' in the high speed mode to be divided into two segments $T_4$, $T_5$, before supplying the drive-voltage-waveform SD0 to the latter half of the segment $T_5$. In order to materialize the gradation value "1", it is suitable that it causes the drive-voltage-waveform SD1 to be supplied to the first of the segment $T_4$. In order to materialize the gradation value "3", it is suitable that it causes the drive-voltage-waveforms SD3 to be supplied to both of the first half of the segment $T_4$ and the latter half of the segment $T_5$ while causing the switch to be ON state. In order to materialize the gradation value "6", it is suitable that it causes the drive-voltage-waveform SD6 to be supplied to both of the first half of the segment $T_4$ and the latter half of the segment $T_5$ while causing the switch to be ON state.

In the third embodiment, in the same way as the second embodiment, it is capable of preventing non-discharging or bad-discharging caused by increasing of coefficient of viscosity of the ink within the ink chamber due to the fact that it causes the drive-voltage-waveform SD0 to be given. The drive-voltage-waveform SD0 causes the ink chamber 4 to vibrate in the degree that the ink-drop is not discharged.

Further, even though one printing period T is short printing period T' in the high speed printing, it is capable of obtaining a plurality of gradations (four kinds of gradation in this case). Thus, there is the merit that it is capable of obtaining high quality printing image in the high speed printing.

Now, in the respective embodiments described above, the drive-voltage-waveform, the number of kind of the drive-voltage-waveform, time of division in one printing period and the number of the segment according to the division, and switching of the switch are determined according to correlation between printing period (printing time) and image quality.

A central processing unit (CPU) controls respective parts of the ink-jet printer. A personal computer supplies printing data to the ink-jet printer. The CPU which constitutes an information processing device such as the personal computer selects the drive method according to image quality mode set by the operator. Thus, it is suitable that the method and the device are constituted such that the CPU selects the drive method according to image quality mode set by the operator, and it causes data concerning the drive method to be supplied to the controller 31.

Further, it is suitable that the method and the device are constituted such that the controller 31 selects the drive method directly according to the data concerning image quality mode transmitted from the CPU of the ink-jet printer and/or the CPU constituting the image processing device.

It is capable of listing the high speed printing mode, high image quality mode, and so forth as the image quality mode. The high-speed printing mode is a mode set in the case where printing with high speed is required even though the image quality is somewhat deteriorated such as trial-printing and so forth for checking the whole layout of the image and so forth. The high image-quality mode is a mode set in the case where printing with high image-quality is required even though it takes time slightly for the sake of printing.

There have been described the preferred embodiments of the invention. However, the present invention is not limited by the above described embodiments.

For instance, in the above-described embodiments, there have been described only the case where it causes the gradation-recording to be implemented with one-color. However, it causes color gradation-recording to be possible in such a way that the ink-jet recording head is provided with a plurality of nozzles discharging a plurality of colors of the ink-drops.

Further, in the above-described embodiments, there have been described that the controller 31 supplies the parallel waveform/nozzle selection data DSWN to the switching part 34. However, this is not restricted by the above-described operation. It is suitable that it only enables the switch to be switched. Furthermore, it is suitable of constitution supplying the nozzle selection data DSWN. Moreover, it is suitable of constitution that the switching part 34 is provided with a decoder to supply the gradation value data in every respective nozzles $\mathbf{2}_1$ to $\mathbf{2}_4$.

Furthermore, there have been described that the controller 31 supplies the discharging start command signal to the waveform generator 33. However, this is not restricted by the above matter. There is provided a position detection means such as a position encoder for detecting position of the ink-jet recording head 1. The position detection means detects the ink-jet recording head 1 passing through the prescribed pixel position. It is suitable of constitution that it causes the discharging start command to be supplied to the waveform generator 33 in accordance with the detection signal of the position detection means.

Moreover, in the above-described embodiments, there have been described that the controller 31 implements selection of the drive-voltage-waveform signal and so forth in respective scanning processing. However, this is not restricted by the above matter. It is suitable of constitution implementing selection of the drive-waveform signal according to the control from the external part.

Still moreover, in the above description, there have been described that the waveform generator 33 is provided with three waveform generation circuits 35*a*, 35*b*, 35*c*. However, it is suitable of constitution that the waveform generator 33 is provided with more than four waveform generation circuits.

Still moreover, there have been described that it causes the one printing period T to be divided into two segments. However, it is also suitable that it causes the one printing period T to be divided into more than three segments if it enables the timing of switching of ON/OFF of the switches $\mathbf{37}_{1a}$. . . $\mathbf{37}_{4c}$ to be lengthened more than the maximum continuous drive frequency. Such the constitution enables the number of gradation materialized during the one printing period to be increased.

Still moreover, there have been described that one of the plurality of drive-voltage-waveforms is supplied to one of either the first half or the latter half of two-divided printing period T. However, it is capable of supplying selected drive-voltage-waveform to both of the first half and the latter half. Namely, it becomes possible to materialize more gradations in such a way that it causes the drive-voltage-waveform to be supplied so as to cause different gradation of the ink-drop to be discharged in respective the first half and the latter half.

Still moreover, in the above-described embodiments, there have been described that the waveform generation circuit generates the drive-voltage-waveform. However, it is suitable that the waveform generation circuit generates current-waveform and/or another waveform with the exception of the voltage-waveform if it is capable of causing the ink-drop to be discharged from the nozzle while changing volume within the ink chamber.

According to the present invention, the method and the device cause the one printing period to be divided into a plurality of segments. The method and the device cause plural kinds of drive-waveforms to be generated in accordance with the size of the ink-drop in every respective segments. The method and the device select the arbitrary drive-waveform from among plural kinds of the drive-waveforms supplied in very respective segments in order to supply to vibration generation means in every respective segments. Therefore, it becomes to obtain a plurality of gradations during one printing period. Thus, it is capable of obtaining high quality printing image while improving widely the recording speed. The method and the device do not lengthen the recording time even though the number of gradation increases.

Further, constitution of the ink-jet recording head is not required to be complicated, and to be large-sized.

While preferred embodiments of the invention have been described using specific terms, the description has been for illustrative purpose only, and it is to be understood that changes and variations may be made without departing from the spirit or scope of the following claims.

What is claimed is:

1. A drive method of an ink-jet recording head of a drive of an ink-jet recording head including a plurality of ink chamber in which ink is filled, a plurality of nozzles provided for said ink chamber, from which nozzles said ink is discharged, and a vibration generation means provided for respective said ink chambers while corresponding thereto for the sake of generation of pressure change on the inside of said ink chamber, comprising the processes of:

a process for causing the ink-jet recording head to be scanned relatively with respective to a recording medium;

a process for dividing one printing period into a plurality of segments;

a drive-waveform generation process for generating plural kinds of drive-waveform in accordance with size of an ink-drop in every segment; and a drive-waveform supply process for supplying selected said drive-waveform to said vibration generation means in every respective segments while selecting said drive-waveform in accordance with printing condition from among plural kinds of said drive-waveforms in every said segments.

2. A drive method of an ink-jet recording head as claimed in claim 1, wherein said drive-waveform includes a drive-waveform giving infinitesimal vibration to said ink existing in the ink chamber without discharging said ink from said nozzle.

3. A drive method of an ink-jet recording head as claimed in claim 2, wherein there is optionally provided a drive-waveform interruption process for interrupting supply of said drive-waveform for either said drive-waveform supply process or said vibration generation means after said drive-waveform generation process.

4. A drive method of an ink-jet recording head as claimed in claim 1, wherein it causes said drive-waveform, the number of kinds of said drive-waveform, time of division in said one-printing period and the number of said segment, and supply or interruption of said drive-waveform to be set in accordance with the printing condition.

5. A drive method of an ink-jet recording head as claimed in claim 2, wherein it causes said drive-waveform, the number of kinds of said drive-waveform, time of division in said one-printing period and the number of said segment, and supply or interruption of said drive-waveform to be set in accordance with the printing condition.

6. A drive method of an ink-jet recording head as claimed in claim 3, wherein it causes said drive-waveform, the number of kinds of said drive-waveform, time of division in said one-printing period and the number of said segment, and supply or interruption of said drive-waveform to be set in accordance with the printing condition.

7. A drive of an ink-jet recording head including a plurality of ink chamber in which ink is filled, a plurality of nozzles provided for said ink chamber, from which nozzles said ink is discharged, and a vibration generation means provided for respective said ink chambers while corresponding thereto for the sake of generation of pressure change on the inside of said ink chamber, in which said drive of said ink-jet recording head executes printing on recording medium while scanning said recording medium, comprising:

a dividing means for dividing one-printing period into a plurality of segments;

a plurality of waveform generation means which are provided in accordance with size of respective ink-drops, for generating said drive-waveform in every respective segments which are divided by said dividing means;

a switch means which is provided at a signal line for connecting respective said waveform generation means with said vibration generation means, for switching ON/OFF of drive-waveform supplied from said waveform generation means; and a switching means for switching ON/OFF of said switch means in order to supply selected drive-waveform to said vibration generation means while selecting said drive-waveform in accordance with printing condition from among the whole drive-waveforms supplied during said one-printing period.

8. A drive of an inkjet recording head as claimed in claim 7, wherein said drive-waveform includes a drive-waveform giving infinitesimal vibration to said ink existing in the ink chamber without discharging said ink from said nozzle.

9. A drive of an ink-jet recording head as claimed in claim 7, wherein it causes said drive-waveform, the number of kinds of said drive-waveform, time of division in said one-printing period and the number of said segment, and ON/OFF of said switch means to be set in accordance with the printing condition.

10. A drive of an ink-jet recording head as claimed in claim 8, wherein it causes said drive-waveform, the number of kinds of said drive-waveform, time of division in said one-printing period and the number of said segment, and ON/OFF of said switch means to be set in accordance with the printing condition.

* * * * *